US006260982B1

(12) United States Patent
Huebner

(10) Patent No.: US 6,260,982 B1
(45) **Date of Patent: *Jul. 17, 2001**

(54) LIGHTING APPARATUS FOR OPERATING MACHINES WITH OVERHEAD OBSTRUCTIONS AND METHOD

(76) Inventor: John J. Huebner, 121 S. Main St., #3, Greenville, SC (US) 29601

( * ) Notice: Subject to any disclaimer, the term of this patent is extended or adjusted under 35 U.S.C. 154(b) by 0 days.

This patent is subject to a terminal disclaimer.

(21) Appl. No.: 09/426,841

(22) Filed: Oct. 26, 1999

Related U.S. Application Data

(63) Continuation-in-part of application No. 09/260,374, filed on Mar. 1, 1999, now Pat. No. 6,186,647.

(51) Int. Cl.[7] ..... F21S 8/00

(52) U.S. Cl. ..... 362/147; 362/225; 362/217; 362/234; 139/1 C

(58) Field of Search ..... 362/147, 253, 362/234, 260, 263, 217, 223, 307, 225; 139/1 C; 26/70; 356/238.1, 430; 57/308

(56) References Cited

U.S. PATENT DOCUMENTS

| | | | | |
|---|---|---|---|---|
| 3,783,648 | * | 1/1974 | Heinrichs | 139/1 C |
| 4,298,916 | * | 11/1981 | Shemitz | 362/223 |
| 4,573,111 | * | 2/1986 | Herst et al. | 362/223 |
| 4,667,275 | * | 5/1987 | Herst et al. | 362/223 |
| 5,125,034 | * | 6/1992 | Hudson et al. | 139/1 C |
| 5,593,225 | * | 1/1997 | Safyan | 362/223 |
| 5,666,996 | * | 9/1997 | Bollier et al. | 139/1 C |
| 5,902,035 | * | 5/1999 | Mui | 362/147 |
| 5,910,598 | * | 6/1999 | Shofner et al. | 139/1 C |
| 5,934,786 | * | 8/1999 | O' Keefe | 362/147 |
| 6,152,573 | * | 11/2000 | Mitchell | 362/223 |

* cited by examiner

*Primary Examiner*—Thomas M. Sember
(74) *Attorney, Agent, or Firm*—Flint & Kim, P.A.

(57) ABSTRACT

A lighting apparatus for use in air conditioning systems for textile weaving machines utilizing supports (A) carried on the overhead ducts in longitudinal spaced relation between support columns for the ducts wherein a florescent lamp (C) is positioned within an elongated aligned housing (B) to project light evenly through a lens (D) which extends below and on one side of the duct with light being directed by a downwardly extending reflector leg (E) to distribute light in a pattern including cross-directional light evenly across the weaving machines. A cusp (F) comprising downwardly inclined converging surfaces has an apex directly over the florescent lamp (C). The method contemplates positioning a single elongated florescent lamp asymmetrically on one side of the elongated housing, and configuring the reflector asymmetrically to reflect light in a cross-directional pattern so that illumination of obstructed parts of operating machines is achieved. By tilting the lens in the direction of a depending leg E within a tilted fastener (G) reflected light strikes at a more obtuse angle, closer to 90°, for a more efficient utilization of available light. By utilizing a bracket uniformly supporting the lighting fixture more efficient positioning is achieved.

12 Claims, 6 Drawing Sheets

LIGHTING APPARATUS FOR OPERATING MACHINES WITH OVERHEAD OBSTRUCTIONS AND METHOD

This is a continuation-in-part of my application entitled LIGHTING APPARATUS FOR OPERATING MACHINES WITH OVERHEAD OBSTRUCTIONS AND METHOD, Ser. No. 09/260,374, filed Mar. 1, 1999 now U.S. Pat. No. 6,186,647.

BACKGROUND OF THE INVENTION

This invention relates to lighting apparatus and method for use on operating industrial manufacturing machines and more particularly for use with textile weaving machines having an overhead air conditioning duct.

Overall machine efficiency of high-speed textile looms can be improved by the addition of direct air conditioning systems. These systems exhaust conditioned air directly to the harness area of the textile loom. Other air conditioning systems require that the entire room be conditioned in order to achieve the proper combination of humidity and temperature for optional loom operation. Systems delivering conditioned air directly to weaving machines typically require the installation of air ducts directly over the harness area. Exhaust air outlets direct the conditioned air from the duct into the area of the loom where the weaving operation takes place.

These overhead ducts produce shadows on the weaving machines due to their blockage of light from conventional ceiling mounted illumination sources. The installation of a traditional florescent fixture or luminaire with the usual symmetrical light distribution pattern alongside the duct, will illuminate one side of the machine, typically the weave side, at the expense of the other side of the machine, the warp side. Also, a portion of the light will fall onto aisle and floor areas, resulting in inefficiency by reason of lost light.

The prior art is exemplified by the LOOMSPHERE air conditioning system by Luwa Bahanson, Inc. of Zurich, Switzerland and Winston-Salem, N.C. Features of the air conditioning system are illustrated in U.S. Pat. No. 5,666,966 where it will be noted that the elongated horizontal ducts are supported by columns longitudinally spaced in aisles between looms. Conditioned air is directed downwardly on the looms from whence the air is received in exhaust ducts carried beneath the weaving machines under the floor of the mill for return to air conditioning apparatus. Thus, the areas between the columns is free of obstructions which may interfere with operation and servicing of the weaving machines.

The problem of shading of parts of the weaving machines from conventional florescent light by blockage by overhead ducts has persisted despite efforts to solve the problem. U.S. Pat. No. 5,666,966 illustrates an attempt to solve the problem by positioning a conventional lighting fixture directly beneath the air channel and positioning the outlet box to one side. This attempted solution has resulted in disadvantages including the extra expense of the ducts and air channels. Inefficiencies result because of pressure drops occurring in the more extensive duct work of the proposed system.

SUMMARY OF THE INVENTION

Accordingly, it is an important object of the invention to provide an improved luminaire capable of by-passing obstructions for illuminating an entire operating machine evenly thereacross.

Another important object of the invention is to provide positioning devices carried by an air duct above a textile weaving machine between duct supports extending just below the duct so that a luminaire transmits light evenly across the operating machines below.

By positioning the supports for a lighting fixture on the duct as by the cantilevered supports or supports attached directly to the sides of the ducts for surface or pendant mounting, light blockage may be eliminated while maintaining full accessibility to the operating machines.

Another important object of the invention is to provide an improved luminaire having one or more florescent lamps utilizing cross-directional reflectors.

Another important object of the invention is to provide a luminaire utilizing a specular reflector providing a smooth effective surface having a downturned leg between a ballast tray and a lamp for providing cross-directional light to evenly illuminate a machine which is asymmetrically positioned therebeneath.

Another important object of the invention is to utilize ray tracing techniques in conjunction with light meter checks to optimize specular reflectors having downturned legs for cross-directional reflection utilizing one or more florescent lamps.

Another important object of the invention is to provide a luminaire having a specular reflector providing a cusp formed by downwardly extending surfaces forming an inverted apex directly above a florescent lamp so as to avoid returning light which would otherwise be directly returned to the source with loss of light and thereby increase light output of the device.

Another important object of the invention is to provide a luminaire which may be positioned laterally of an overhead duct structure for evenly illuminating weaving machines therebelow while maintaining accessibility to the weaving machines for operators and service personnel.

This invention comprises an asymmetrical specular reflector preferably installed inside a luminaire in order to illuminate entire weaving machines evenly. The light output of the luminaire is increased because the reflector has the capability of usefully reflecting the light that is usually lost within the luminaire housing.

By utilizing lighting apparatus constructed in accordance with the invention approximately one-half of the normally required light source is required to produce the same light output. Superior illumination results are obtained by apparatus constructed in accordance with the invention described when installed in the context of operating weaving machines where normal lighting would be obstructed by overhead ducts.

Some aspects of the invention are generally applicable where operating machines are otherwise obstructed such as spinning frames where overhanging parts obstruct light to operating areas of the machine. Specular reflectors designed to include downturned legs for cross-directional light distribution, together with the use of a cusp above the florescent lamp, make the use of a single lamp preferable to the use of multiple lamps because of the effectiveness achieved thereby.

Another important object of the invention is to provide a lighting fixture having an offset mounting for receiving an asymmetrical reflector having a longer leg on one end than on the other resulting in a reduced profile for the reflector.

Still another object of the invention is to provide an elongated industrial lighting fixture having an inclined lens for accommodating an asymmetrical reflector resulting in more light and more evenly distributed light on the object being lighted.

Another object of the invention is to provide an offset lighting fixture having improved brackets for attaching the fixture in relation to the object to be lighted.

Another significant advantage may be provided by supplying brackets on other suitable fasteners for positioning the lighting fixtures uniformly along the duct.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
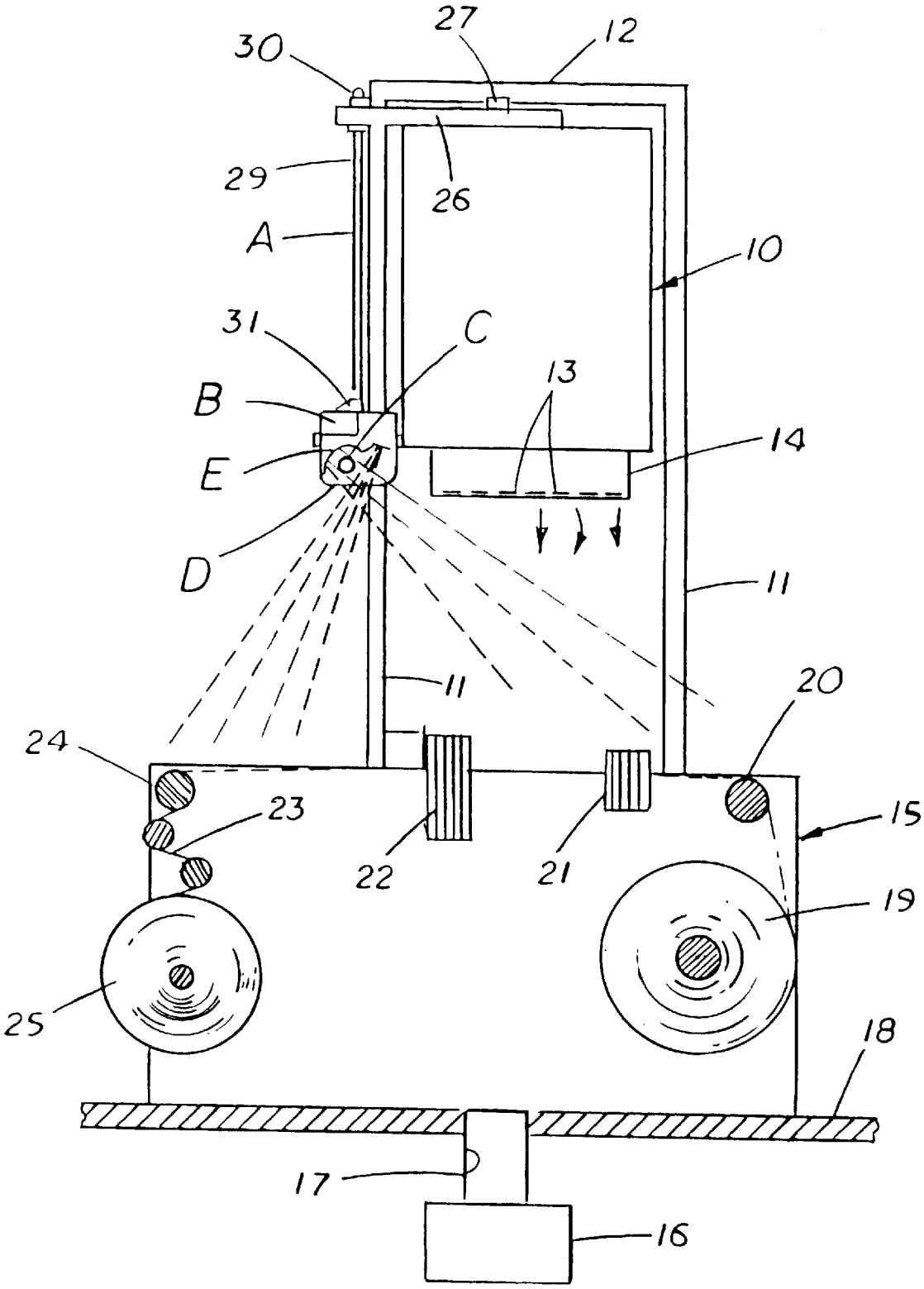
FIG. 1 is a schematic side elevation illustrating lighting apparatus constructed in accordance with the present invention mounted upon an overhead air duct of the type utilized for direct air conditioning systems for weaving machines. The ducts are carried between support columns positioned in aisles between weaving machines directly over the harnesses.
Figure 2:
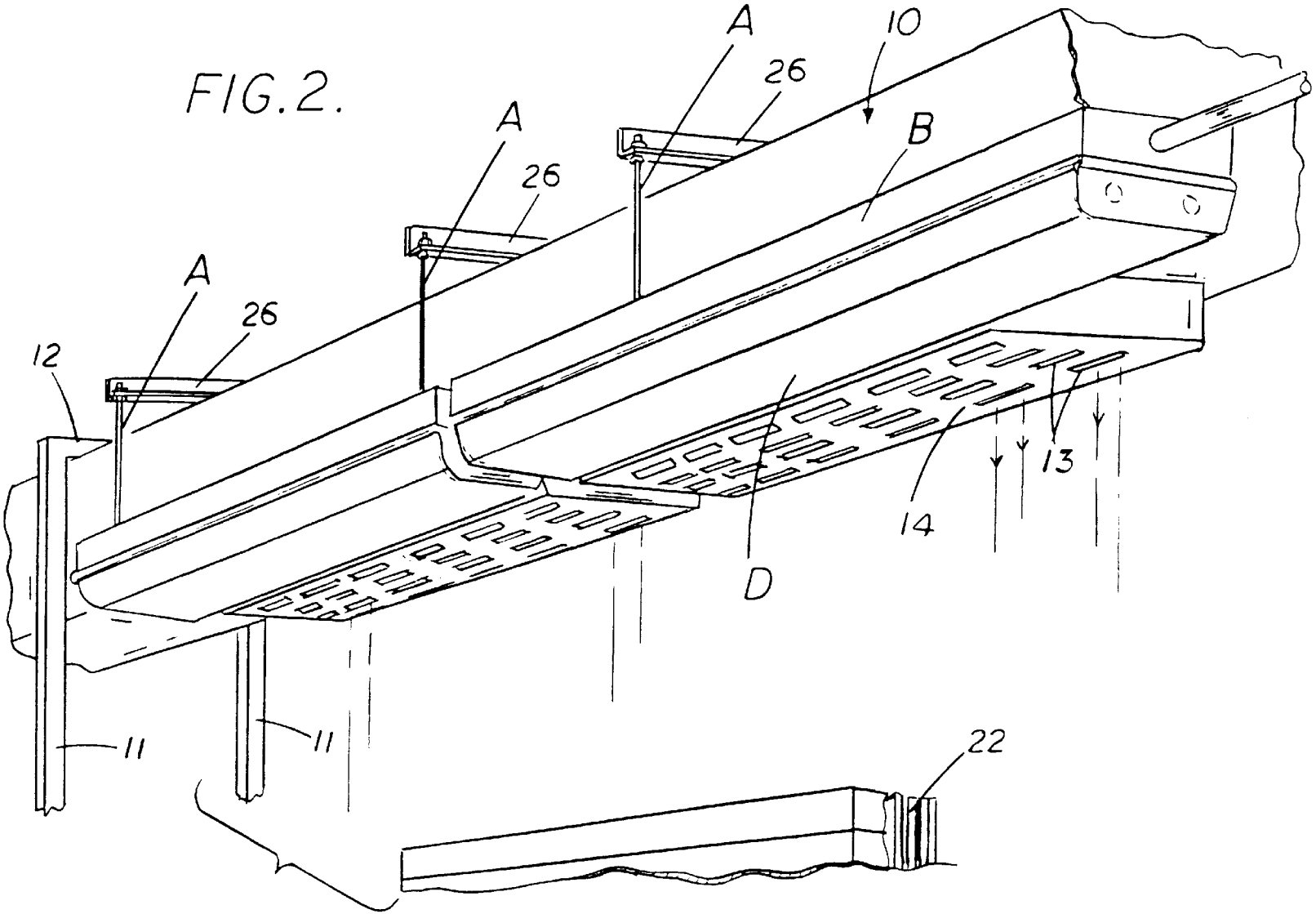
FIG. 2 is a left perspective view further illustrating the mounting of the lighting apparatus constructed in accordance with the present invention above weaving machines as in FIG. 1.
Figure 4:
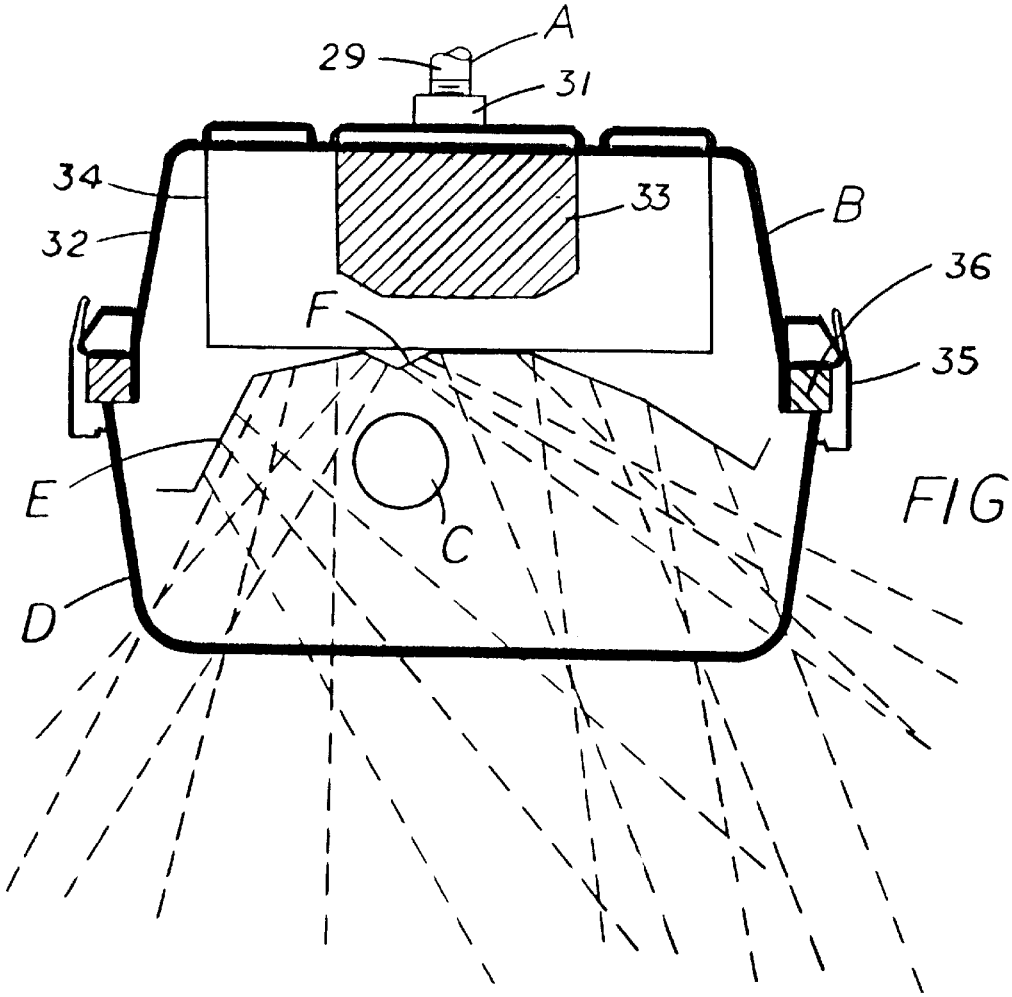
FIG. 4 is a transverse sectional elevation similar to FIG. 3 further including a ray trace illustrating a cross-directional throw of light from left to right in FIG. 1 evenly across the weaving machine. A cusp is illustrated in FIGS. 3 and 4 wherein light which would normally be reflected back into the source has been made use of through the converging downwardly and upwardly directed reflector surfaces forming the cusp above the florescent lamp. If required, a luminaire may be constructed utilizing a pair of aligned florescent lamps instead of the single lamp construction illustrated.
Figure 3:
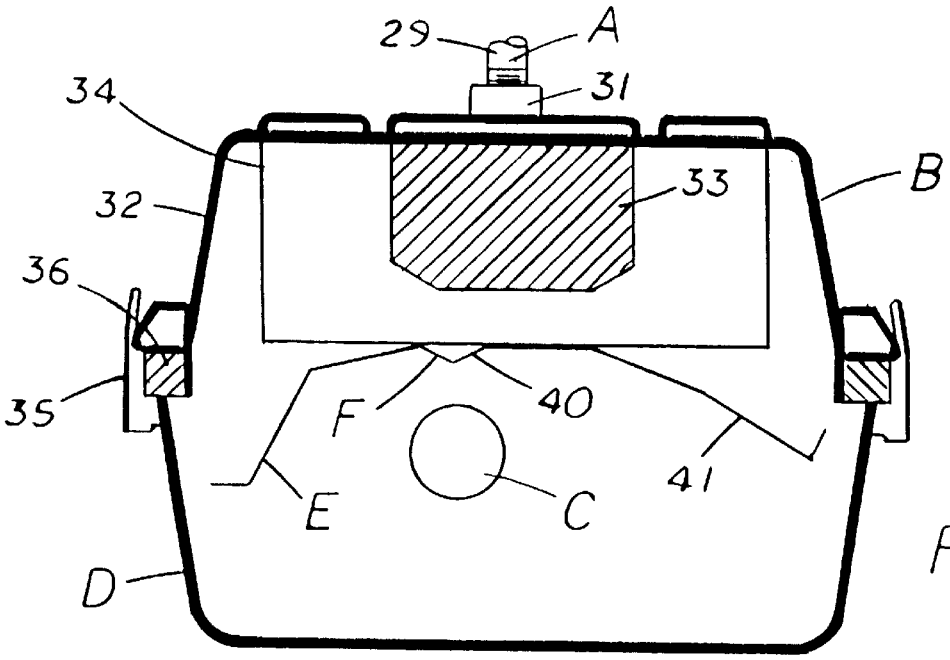
FIG. 3 is a transverse sectional elevation schematically illustrating the structure of the luminaire wherein a florescent lamp is asymmetrically positioned in a lower part of a housing on one side thereof. This provides space for asymmetric positioning of the reflector in respect to the lamp providing a longer horizontal leg on one side of the reflector.

The drawings in FIGS. 1 and 2 illustrate lighting apparatus for use in an air conditioning system for textile weaving machines having a weaving area on a cloth side of a heddle assembly opposite a warp side including, an air duct positioned on columns spaced between the weaving machines. Depending structural supports A are longitudinally spaced between the columns carried by and extending downwardly on one side of the air duct. An elongated housing B has ballast on an upper side and at least one elongated florescent lamp C aligned within a lower side of the housing fixed to the structural supports. A lens D is provided sealing the housing on a lower side of the elongated housing for lighting weaving machines below the duct. A specular reflector having a downturned leg E is carried within the elongated housing configured for directional distribution of light from the fixture across the weaving area and warp side of respective weaving machines. A cusp F is illustrated in FIGS. 3 and 4 directly above a single lamp. The method contemplates positioning the housings containing lamps and reflectors on the ducts between support columns, and utilizing asymmetrical reflectors to provide cross-directional light with distribution evenly across the machines.

By tilting the lens to an angle compatible with the angle of the downturned leg by utilizing a tilted fastener F more efficient light utilization is achieved.

Referring more particularly to FIG. 1, a duct assembly broadly designated as at 10 extends across the looms and is supported upon columns 11. Columns 11 are spaced between several looms as illustrated in U.S. Pat. No. 5,666,966. The columns are provided at each end of a duct section, joined at the top by a cross frame member 12. A number of outlets 13 are provided in an outlet box 14 carried by and forming a part of the duct assembly 10.

The weaving machines, broadly designated as at 15, are spaced between columns 11 above an air return duct 16 which receives air, after passing over the looms, through ducts 17 in the floor 18 of the mill. The loom 15 is illustrated as including the usual warp beam 19 supplying warp yarn over a roll 20, through drop wires 21 and a harness assembly 22. Weaving takes place at the left side of the machines and cloth is illustrated as at 23 passing over the usual sand roll 24 to form a cloth roll 25.

FIGS. 1 and 2 best illustrate suitable structural supports A which are suitably connected to the duct assembly 10. As illustrated, a number of spaced cantilevered members 26 are bolted as at 27 to an upper surface of the duct 10. The member 26 threadably carries a depending rod member 29 which is provided with suitable nuts 30 to provide threadable adjustment to the depending members 29. The rods 29 are connected by a fastener 31 to the elongated housing B.

The housing B is illustrated in FIGS. 3 and 4 as having an inverted upper generally U-shaped member 32 above the florescent tube. A suitable electronic ballast 33 is illustrated in the upper part of the housing within a channel 34. A lower flange 35 within the inverted housing 32 carries a sealing member 36 to afford a vapor seal between the lens D and the housing B. The reflector has a downturned leg E and preferably has a specular finish to enhance reflective properties of the reflector and to provide cross-directional delivery of light downwardly across the harness assembly for even light distribution across the weaving machines.

A cusp F is illustrated as being formed by the convergence of downwardly and inwardly converging legs 40 of the reflector. By the asymmetrical mounting of the light bulb C within the fixture, a longer leg 41 is provided for by a given reflector so as to direct light across a greater distance to the side of the weaving machine adjacent to the warp yarns.

Figure 5:
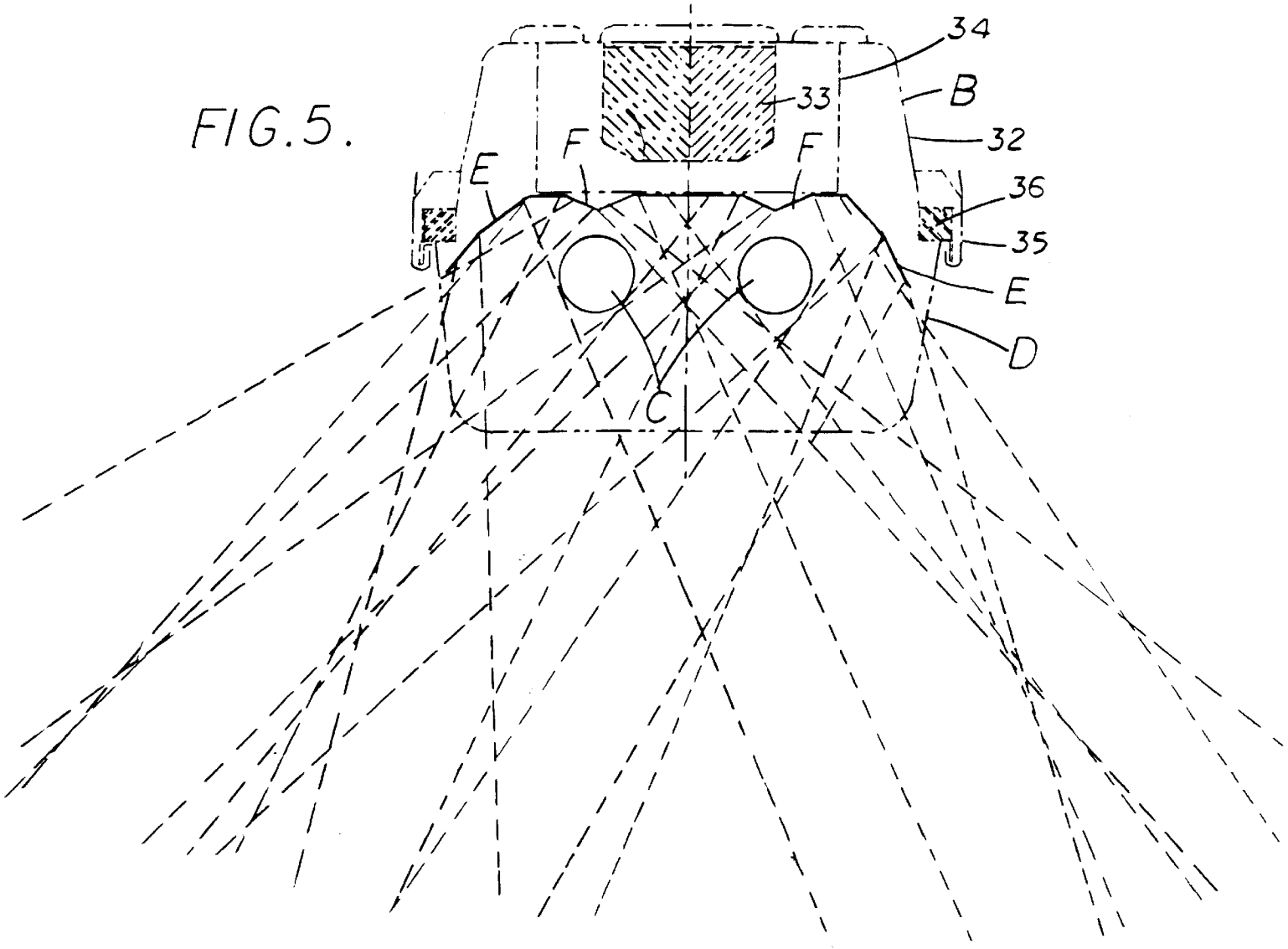
FIG. 5 is a transverse sectional elevation similar to FIG. 4 including a ray trace illustrating a modified form of the invention with dual lamp construction and reflector having opposed downturned legs and a cusp above each florescent lamp.

FIG. 5 illustrates a dual lamp fixture constructed in accordance with a modified form of the invention wherein downturned reflector members E are provided at each end of the reflector. Each downturned member throws light at a different cross-directional angle to provide a desired overall pattern so as to encompass objects at different desired distances on each side.

Figure 6:
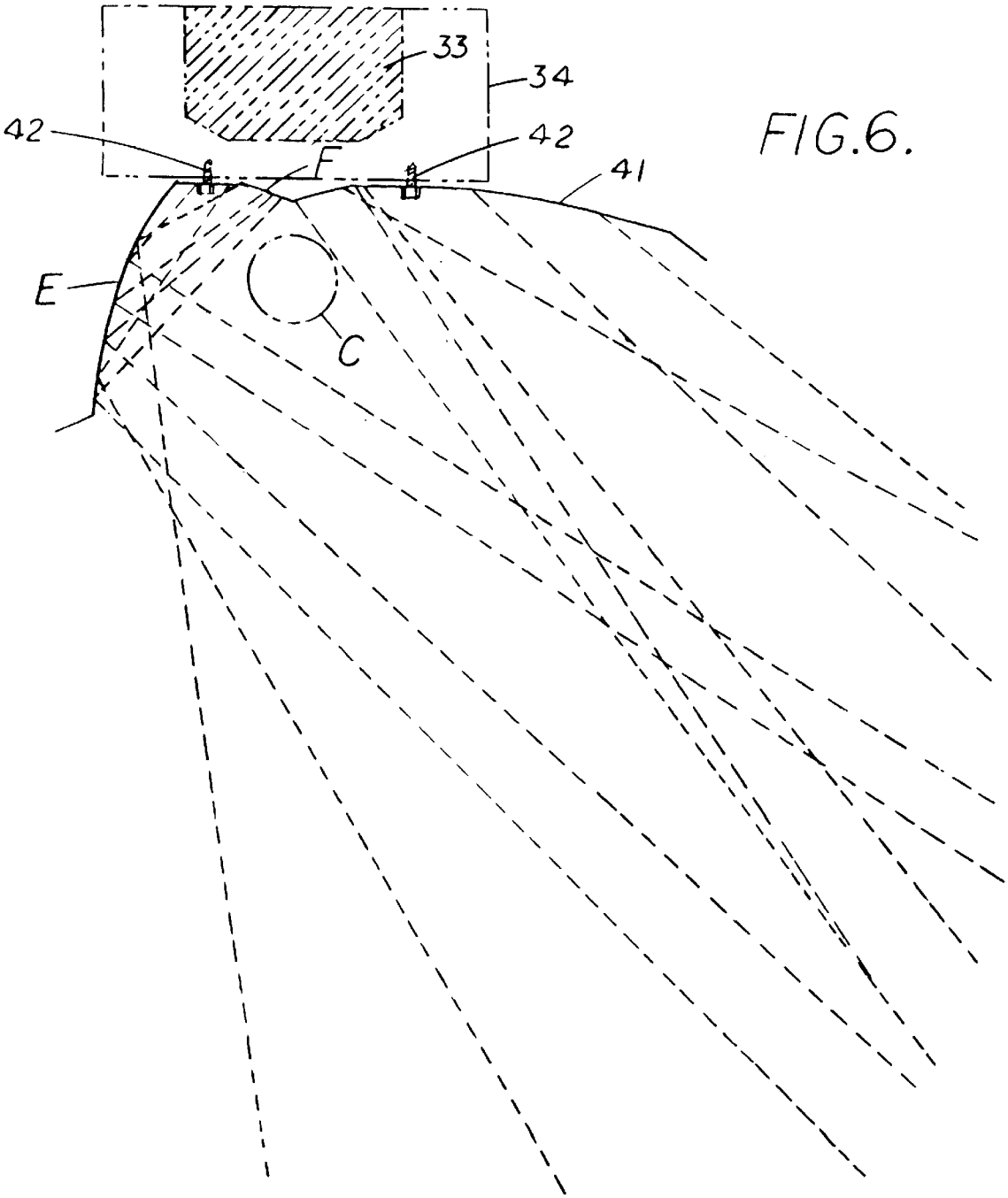
FIG. 6 is a transverse sectional elevation similar to FIG. 4, with parts omitted and without a lens, illustrating a light fixture for use in applications where a vapor seal is not required as with spinning where dust is not so prevalent as it is with aggressive machine action as occurs in weaving machine operation. Open constructions may be used in some weaving applications where excessive dust or lint is not present.

FIG. 6 is a schematic transverse sectional elevation illustrating another form of the invention useful for yarn spinning and weaving equipment that is obstructed by overhanging parts. The design of the downturned leg E calls for a more pronounced throw of light toward the right by asymmetric positioning of the reflector in respect to the lamp. A cusp F is directly above the florescent bulb C. An elongated horizonal leg is illustrated at 41. The reflector and the bulb are suspended beneath the channel 34 and secured by sheet metal screws 42. The bottom of the fixture is open since the presence of dust, lint and the like is not in sufficient quantity to justify sealing of the fixture.

Figure 7:
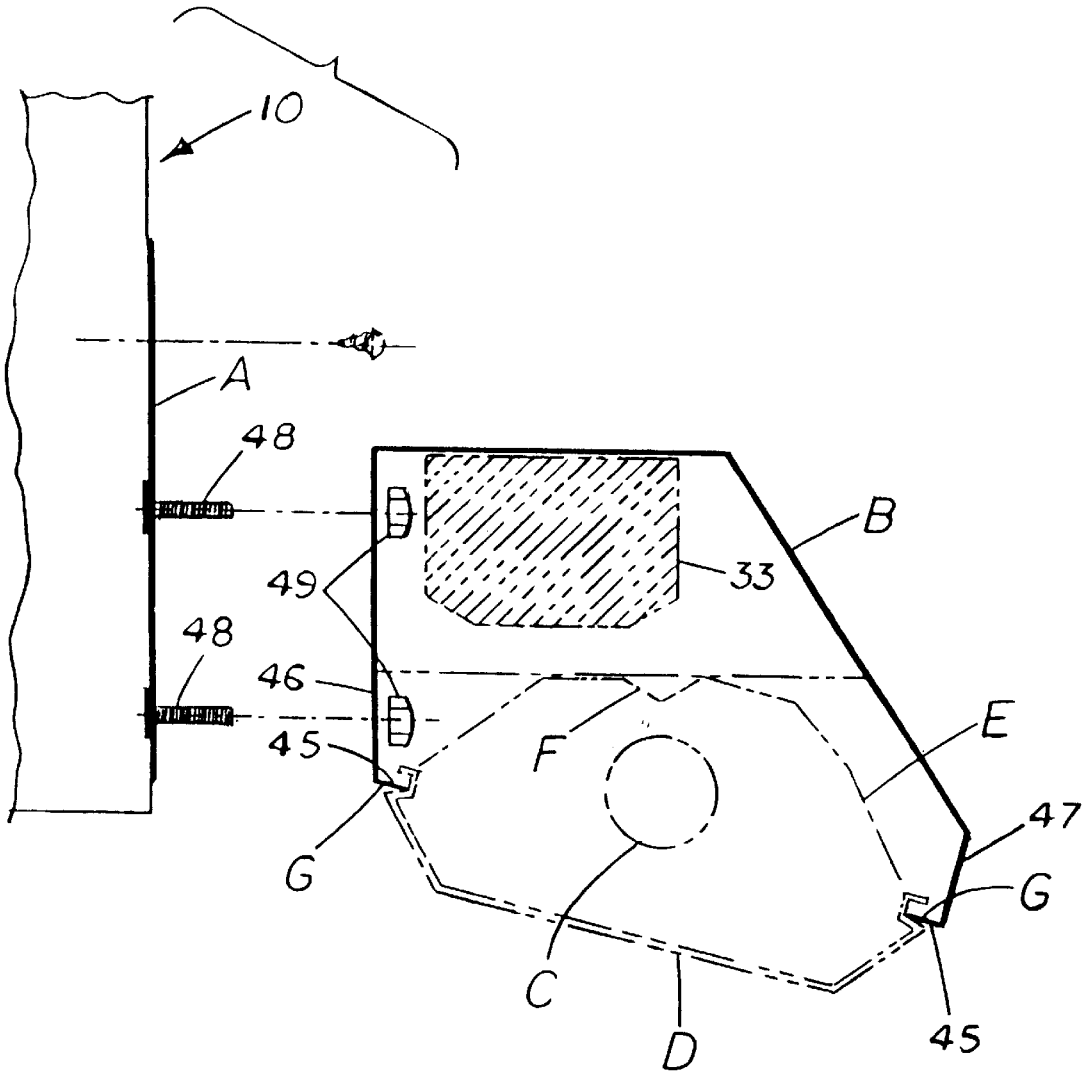
FIG. 7 is a transverse sectional elevation illustrating an offset reflector having an inclined lens for more and better light distribution, with attachment for easier securement in relation to a lighted object.

FIG. 7 illustrates lighting apparatus for delivering more light more uniformly to illuminate objects below. An elongated housing B contains at least one elongated florescent lamp within the housing. The housing B is suitably fastened as by a bracket A to a support such as the duct 10. An asymmetric reflector within the housing above the florescent lamp having a downwardly and outwardly extending leg E of reflective material within the housing. An inclined fastener G adjacent to a lower edge of the housing extends generally at an incline in the direction of the leg inwardly from the horizontal for containing a lens in an inclined plane directing light from the downwardly and outwardly extending leg. The fastener is illustrated as opposed longitudinal inturned flanges 45 at free lower edges of the depending housing walls 46 and 47. Thus light emitted from the florescent lamp as well as from the downwardly and outwardly extending leg is directed inwardly more uniformly and effectively upon objects below.

The lighting fixture illustrated has a vertical upright wall 46 which is secured to the bracket A as by screws 48 and bolts 49. The lighting fixtures may be secured in fixed relation to a duct and the like by any suitable fastener so as not to unduly interfere with access to objects below. References to geometric values herein are for the purpose of indicating a relation of the parts and is not dependent upon the orientation of the device in relation to objects to be lighted.

While a preferred embodiment of the invention has been described using specific terms, such description is for illustrative purposes only, and it is to be understood that changes and variations may be made without departing from the spirit or scope of the following claims.

What is claimed is:

1. Lighting apparatus for use in illuminating obstructed areas of producing machines comprising:

a structural support carried in spaced relation to said producing machines having obstructed areas to be illuminated;

an elongated housing fixed to the structural support and having a ballast on an upper side and a pair of elongated florescent lamps aligned within a lower side of the housing;

a lower side of the elongated housing for emitting light upon said producing machines;

a specular reflector within the elongated housing configured for directional distribution of the light across the obstructed areas; and a downwardly inclined component of the specular reflector asymmetrically positioned in respect to the elongated florescent lamps for reflecting light in a cross-directed path.

2. The lighting apparatus set forth in claim 1 including a cusp directly over the elongated florescent lamp formed by the convergence of two downwardly directed reflector surfaces.

3. The lighting apparatus set forth in claim 2 including a lens sealing the lower side of the housing.

4. The lighting apparatus set forth in claim 2 wherein the lower side of the housing is open.

5. The lighting apparatus set forth in claim 1 wherein said single elongated florescent lamp and said downwardly inclined component are asymmetrically arranged on one side of said housing.

6. Lighting apparatus for use in illuminating obstructed areas of industrial manufacturing machines comprising:

spaced structural supports carried above the industrial manufacturing machines;

an elongated housing fixed to the structural supports having ballast on an upper side and at least one elongated florescent lamp aligned within a lower side of the housing;

a lower side of the elongated housing for emitting light upon the industrial manufacturing machines;

a specular reflector within the elongated housing configured for directional distribution of light across the industrial manufacturing machines; and at least one downwardly inclined component of the specular reflector asymmetrically arranged in respect to said at least one lamp for reflecting light in a cross-directed path.

7. The lighting apparatus set forth in claim 6 including a cusp directly over the at least one elongated florescent lamp formed by the convergence of two downwardly directed reflector surfaces.

8. The lighting apparatus set forth in claim 7 including a lens sealing the lower side of the housing.

9. The lighting apparatus set forth in claim 7 wherein the lower side of the housing is open.

10. Lighting apparatus for delivering more light more uniformly for illuminating objects below comprising:

a substantially vertically extending bracket secured with an overhead structure;

an elongated housing having at least one substantially vertical upright wall and containing at least one elongated florescent lamp aligned within the housing:

connectors connecting said substantially vertical upright wall in fixed position with said bracket;

an asymmetric reflector aligned within the housing above the florescent lamp having a downwardly and outwardly extending leg of reflective material within the housing; and an inclined fastener adjacent to a lower edge of the housing extending generally at an incline in the direction of the leg inwardly from the horizontal for positioning a lens in an inclined plane directing light from the downwardly and outwardly extending leg;

whereby light emitted from the florescent lamp as well as from the downwardly and outwardly extending leg is directed inwardly more uniformly and effectively upon said objects below.

11. The lighting apparatus of claim 10 wherein said reflector includes a cusp directly over the elongated florescent lamp formed by the convergence of two downwardly directed reflector surfaces.

12. The lighting apparatus of claim 10 wherein said asymmetric reflector includes a plurality of downwardly and outwardly extending legs of reflecting material within said housing.

* * * * *